US005551897A

United States Patent [19]

Alwine

[11] Patent Number: 5,551,897

[45] Date of Patent: Sep. 3, 1996

[54] ELECTRICAL CONTACT

[75] Inventor: K. Troy Alwine, Warren, Pa.

[73] Assignee: OSRAM Sylvania Inc., Danvers, Mass.

[21] Appl. No.: 385,415

[22] Filed: Feb. 8, 1995

[51] Int. Cl.[6] ..... H01R 11/22

[52] U.S. Cl. ..... 439/850; 439/852; 439/843

[58] Field of Search ..... 439/850–852, 439/858, 861, 839, 843

[56] References Cited

U.S. PATENT DOCUMENTS

| | | | |
|---|---|---|---|
| 3,862,792 | 1/1975 | Jayne | 439/851 |
| 4,152,042 | 5/1979 | Ostapovich | 439/852 |
| 4,367,006 | 1/1983 | Rehbogen, Jr. et al. | 439/858 |
| 4,657,336 | 4/1987 | Johnson et al. | 439/852 |
| 4,722,704 | 2/1988 | VanDerStuyf et al. | 439/851 |
| 4,834,681 | 5/1989 | Chaillot | 439/852 |
| 5,281,175 | 1/1994 | Chupak et al. | 439/852 |

*Primary Examiner*—P. Austin Bradley
*Assistant Examiner*—Jill DeMello
*Attorney, Agent, or Firm*—William H. McNeill

[57] ABSTRACT

An electrical contact is provided which includes an upper and lower bifurcated beam having contact areas which are staggered. The beams extend from a bridging portion from which outer enclosing members also extend. The outer enclosing members protect the beams from damage, and the sides of the beams are open to facilitate insertion of a blade terminal.

20 Claims, 3 Drawing Sheets

ELECTRICAL CONTACT

BACKGROUND OF THE INVENTION

1. Field of the Invention

The present invention relates to an electrical contact for use with a conventional blade terminal.

2. Description of the Prior Art

The need for a satisfactory electrical contact for use with various electronic equipment and the like is well known. One of the problems incurred in some prior art electrical contacts is the tendency for the beams which form the contact surfaces which engage the blade terminal to become damaged. Damage may occur as a result of incidental engagement of the beams by some object or during insertion of the blade terminal into the electrical contact. Damage may also result due to stubbing or when excessive force is required to mate the terminals. Another problem is that in some installations it is desired or necessary to provide a grommet for use with the electrical contact to, for example, isolate the electrical contact from various environmental considerations such as moisture and dirt. However, it is sometimes difficult to insert prior art-type electrical contacts through the grommet opening. There is also a tendency for the beams of the electrical contact to be overstressed when the blade terminal is inserted therein. In some instances the normal force between the beams and the blade is less than desirable thereby deterring a satisfactory electrical connection. Another problem incurred in the art is the tendency of the electrical contact to become overheated in some applications. In some applications which require multiple electrical contacts, there is a limitation provided regarding the positioning thereof to accommodate mating with respective multiple blade terminals.

It is an object of the present invention to provide an electrical contact having upper and lower beams which are protected from damage.

It is another object of the present invention to provide such an electrical contact which may be inserted into a grommet with ease.

Yet another object of the present invention is to provide such an electrical contact in which the beams exert a high normal force upon a blade terminal inserted therebetween and yet are subjected to a reduction in stress.

A further object of the present invention is to provide such an electrical contact in which the beams are provided with a heat sink.

Another object of the present invention is to provide such an electrical contact in which each beam provides an increase in contact area when mated with a blade terminal thereby providing lower interface resistance and a lower temperature rise over a given current.

Yet a further object of the present invention is to provide such an electrical contact wherein the beams are configured to require a substantially lower blade terminal insertion force.

It is another object of the present invention to provide multiple electrical contacts which allow for straight-on or pivotal mating between the blade terminal and respective beams thereby allowing a more generous positioning thereof.

SUMMARY OF THE INVENTION

This invention achieves these and other results by providing an electrical contact comprising a first bifurcated beam which is electrically conductive and extends in the direction of a longitudinal axis and a second bifurcated beam which is electrically conductive and extends in the direction of such longitudinal axis, the second bifurcated beam being spaced from the first bifurcated beam. A first outer enclosing member which is electrically conductive extends in the direction of the longitudinal axis adjacent to and spaced from the first bifurcated beam. A second outer enclosing member which is electrically conductive extends in the direction of the longitudinal axis adjacent to and spaced from the second bifurcated beam. A bridging portion which is electrically conductive joins the first bifurcated beam, the second bifurcated beam, the first outer enclosing member and the second outer enclosing member.

BRIEF DESCRIPTION OF THE DRAWINGS

This invention may be clearly understood by reference to the attached drawings in which.

DESCRIPTION OF THE PREFERRED EMBODIMENT

Figure 1:
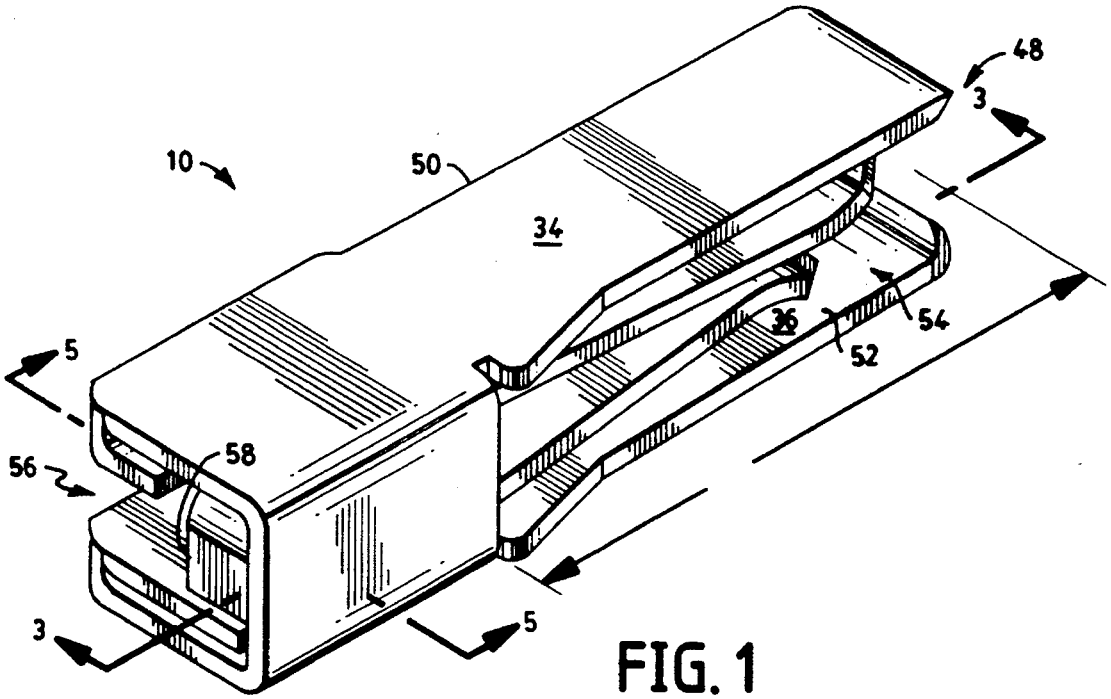
FIG. 1 is a perspective view of an electrical contact embodying the present invention.
Figure 2:
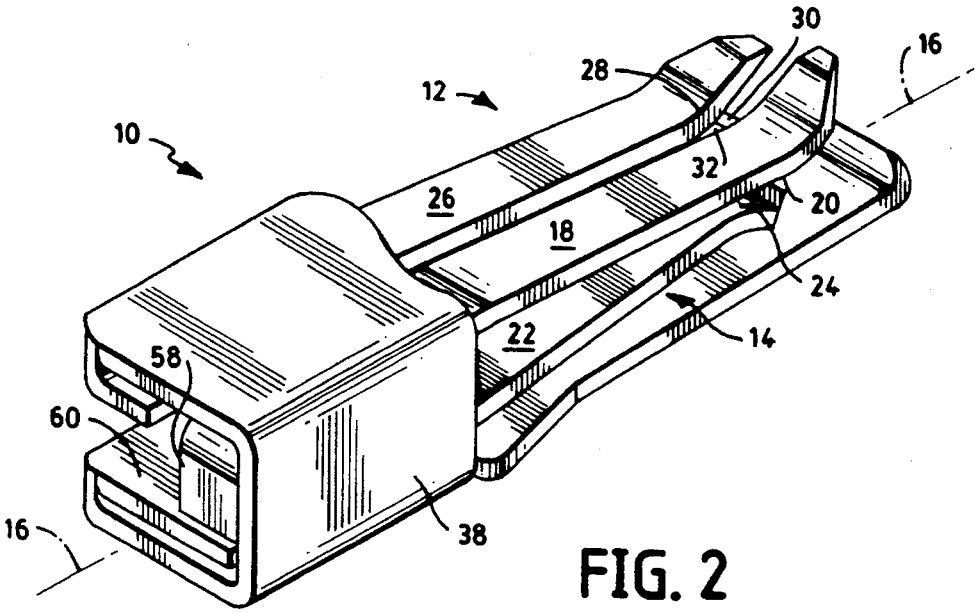
FIG. 2 is identical to FIG. 1 with the upper outer enclosing member removed.
Figure 3:
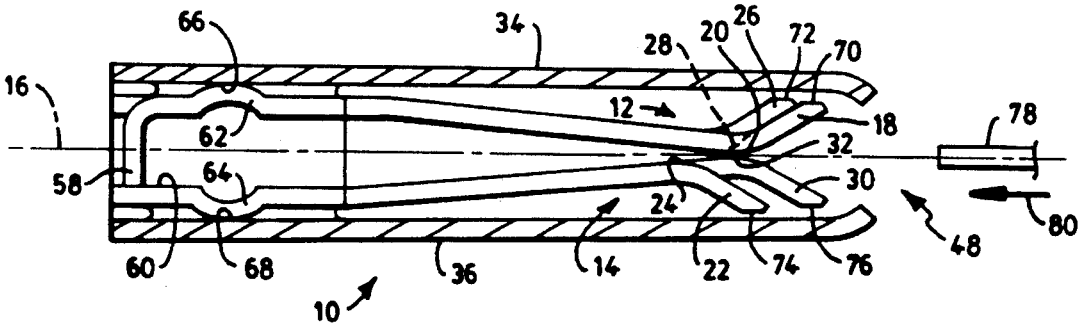
FIG. 3 is a cross-sectional view taken along lines 3—3 of FIG. 1.

The embodiment of this invention which is illustrated in FIGS. 1 to 3 is particularly suited for achieving the objects of this invention. FIGS. 1 to 3 depict an electrical contact 10 which includes a first bifurcated beam 12 and an opposite second bifurcated beam 14. Electrical contact 10 is for use with a conventional blade terminal which may be, without limitation, 0.8×2.8 mm. Bifurcated beams 12 and 14 are electrically conductive and extend in the direction of a longitudinal axis 16 of the electrical contact 10. Beam 12 is spaced from beam 14 as best depicted in FIG. 3.

In the preferred embodiment, bifurcated beam 12 includes a first tine 18 having a first contact area 20 and bifurcated beam 14 includes an opposite second tine 22 having a second contact area 24. As best depicted in FIG. 3, contact area 24 is staggered relative to contact area 20 in the direction of longitudinal axis 16. Similarly, bifurcated beam 12 includes a third tine 26 having a third contact area 28 and bifurcated beam 14 includes an opposite fourth tine 30 having a fourth contact area 32 which is staggered relative to contact area 28 in the direction of longitudinal axis 16. In the preferred embodiment, contact area 24 is also staggered relative to contact area 28 in the direction of longitudinal axis 16. The use of bifurcated beams such as beams 12, 14 provides a substantial amount of contact area in the mated condition due to the presence of two tines on each contact surface of the inserted blade terminal. This serves to provide lower interface resistance and therefore a lower temperature rise over a given current. In addition, the staggering of the tines provides a lower insertion force which may be about 35% less than that required for a nonstaggered configuration.

Electrical contact 10 also includes a first outer enclosing member 34 which extends in the direction of longitudinal axis 16 adjacent to and spaced from the first bifurcated beam 12 as depicted in FIG. 3. Similarly, a second outer enclosing member 36 is provided which extends in the direction of longitudinal axis 16 adjacent to and spaced from the second bifurcated beam 14. Outer enclosing members 34 and 36 are electrically conductive.

The bifurcated beams 12, 14 and the outer enclosing members 34, 36 are joined by an electrically conductive bridging portion 38. In the preferred embodiment this is accomplished by fabricating the electrical contact 10 from a blank which has been stamped from an electrically conductive material in a conventional manner. Such stamping operation may produce a blank having a configuration as depicted in solid lines in FIG. 4. Subsequent to the stamping operation, the blank 40 may be folded to form the embodiment of FIGS. 1 to 3. In particular, the bridging portion 38 of blank 40 may be folded along lines 40, 42, thereby folding the outer enclosing members 34, 36 and beams 12, 14, to form a general U-shaped configuration. The bridging portion may also be folded along lines 44, 46, thereby folding the bifurcated beams 12, 14, respectively, to a position adjacent to and spaced from respective outer enclosing members 34, 36 as depicted in FIG. 3. In this manner the bifurcated beams 12, 14 form a beam segment 48 having an upper portion 50 enclosed by the outer enclosing member 34, an opposite lower portion 52 enclosed by the outer enclosing member 36, a first open side portion 54 and an opposite second open side portion 56. Outer enclosing members 34 and 36 are substantially parallel. The open side configuration provided at open side portions 54 and 56 allows for straight-on or pivotal-type mating with a blade terminal and reduces stubbing during insertion of the blade terminal between beams 12, 14. Such open side configuration also serves to allow for a more generous positioning of multiple terminals.

Figure 4:
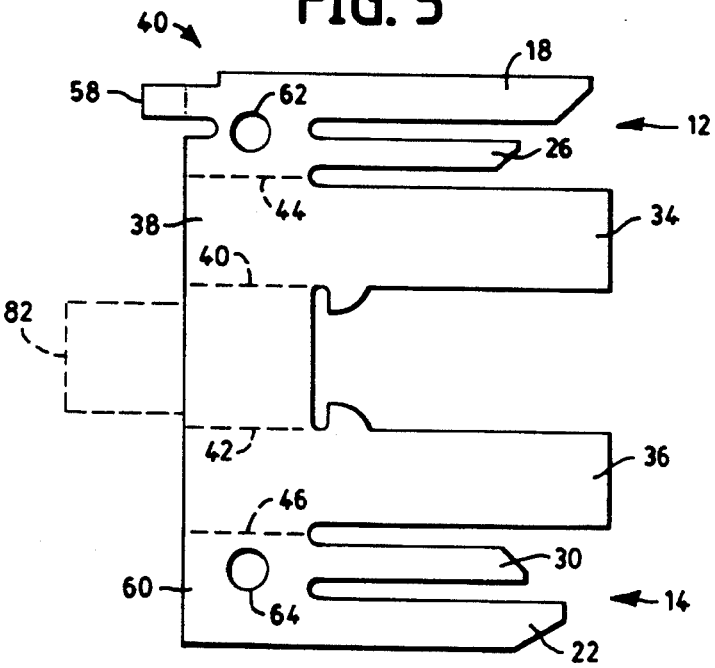
FIG. 4 is a plan view of a blank used to fabricate the electrical contact of FIG. 1.

In the preferred embodiment, the bridging portion 38 includes an end segment 58 adjacent the bifurcated beam 12 as depicted in FIG. 4. Such end segment 58 is in the form of a tag. When the electrical contact 10 is formed, end segment 58 is turned towards and into engagement with a portion 60 of the folded bridging portion 38 adjacent the bifurcated beam 14 as depicted in FIGS. 1 to 3. In the embodiment of FIGS. 1 to 3 the end segment 58 is adjacent the first tine 18 of the bifurcated beam 12 and is turned towards and engages portion 60 adjacent tine 22 of the bifurcated beam 14. End segment 58 serves to maintain separation between outer enclosing member 34 and beam 12, on the one hand, and outer enclosing member 36 and beam 14, on the other.

Figure 5:
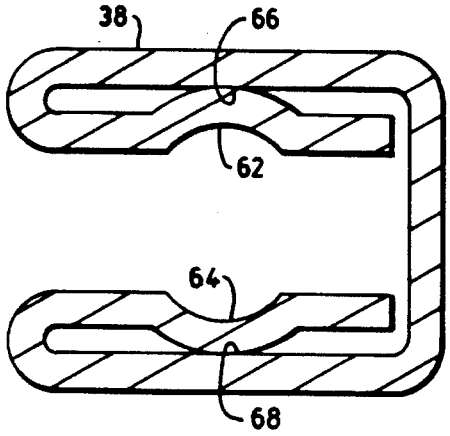
FIG. 5 is a cross-sectional view taken along lines 5—5 of FIG. 1; and, FIG. 6 is a perspective view of an alternate embodiment of the present invention.

In the preferred embodiment, bridging portion 38 comprises a first protuberance 62 which is adjacent the bifurcated beam 12 and a second protuberance 64 which is adjacent the bifurcated beam 14 as depicted in FIG. 4. When viewing FIG. 4, protuberances 62 and 64 extend away from the sheet of paper. Preferably blank 40 is folded as described herein such that protuberance 62 engages folded bridging portion 38 at an area 66 which is adjacent the outer enclosing member 34 to separate outer enclosing member 34 and beam 12, as depicted in FIGS. 3 and 5. Similarly, blank 40 is folded such that protuberance 64 engages bridging portion 38 at an area 68 which is adjacent the outer enclosing member 36 to separate outer enclosing member 36 and beam 14.

In the preferred embodiment, the tines 18, 22, 26 and 30 are tapered in the direction of longitudinal axis 16, each tine narrowing in a direction from the bridging portion 38 towards opposite end 48 of the bifurcated beams 12, 14. The tapered configuration can best be seen in the view of the blank 40 depicted in FIG. 4. When a grommet is required, the tapered tines facilitate insertion of the beams 12, 14 through the grommet opening during installation of the electrical contact.

In order to provide optimum contact with the bifurcated beams 12, 14, beams 12, 14 are biased towards each other. For example, in the preferred embodiment the first contact area 20 and the second contact area 24 are biased towards each other, and the third contact area 28 and the fourth contact area 32 are biased towards each other, as best depicted in FIG. 3. The ends 70, 72 of respective tines 18, 26 are bent away from the ends 74, 76 of respective tines 22, 30, as best depicted in FIG. 3.

In considering the embodiment of FIGS. 1 to 3, the outer enclosing members 34, 36 serve to protect the beams 12, 14 from damage. Members 34, 36 also act as a stress reducer for the beams 12, 14, when mated with a blade terminal 78, and maintain a high normal force between the beams and the blade terminal. In particular, upon insertion of the blade terminal 78 in the direction of arrow 80 between tines 18, 22 and between tines 26, 30, flexing of respective tines 18, 26 away from tines 22, 30 will be limited by the engagement of tine ends 70, 72 with outer enclosing member 34 and the engagement of tine ends 74, 76 with outer enclosing member 36. At the same tine, as the tines 18, 26 and 22, 30 are compressed between the members 34, 36, respectfully, and the blade terminal 78, the resilience of the tines will maintain a high normal force between the tines and the contact surfaces of the blade terminal. Outer enclosing members 34, 36 also provide a conductive path in the mated condition, thereby acting as a heat sink.

Figure 6:
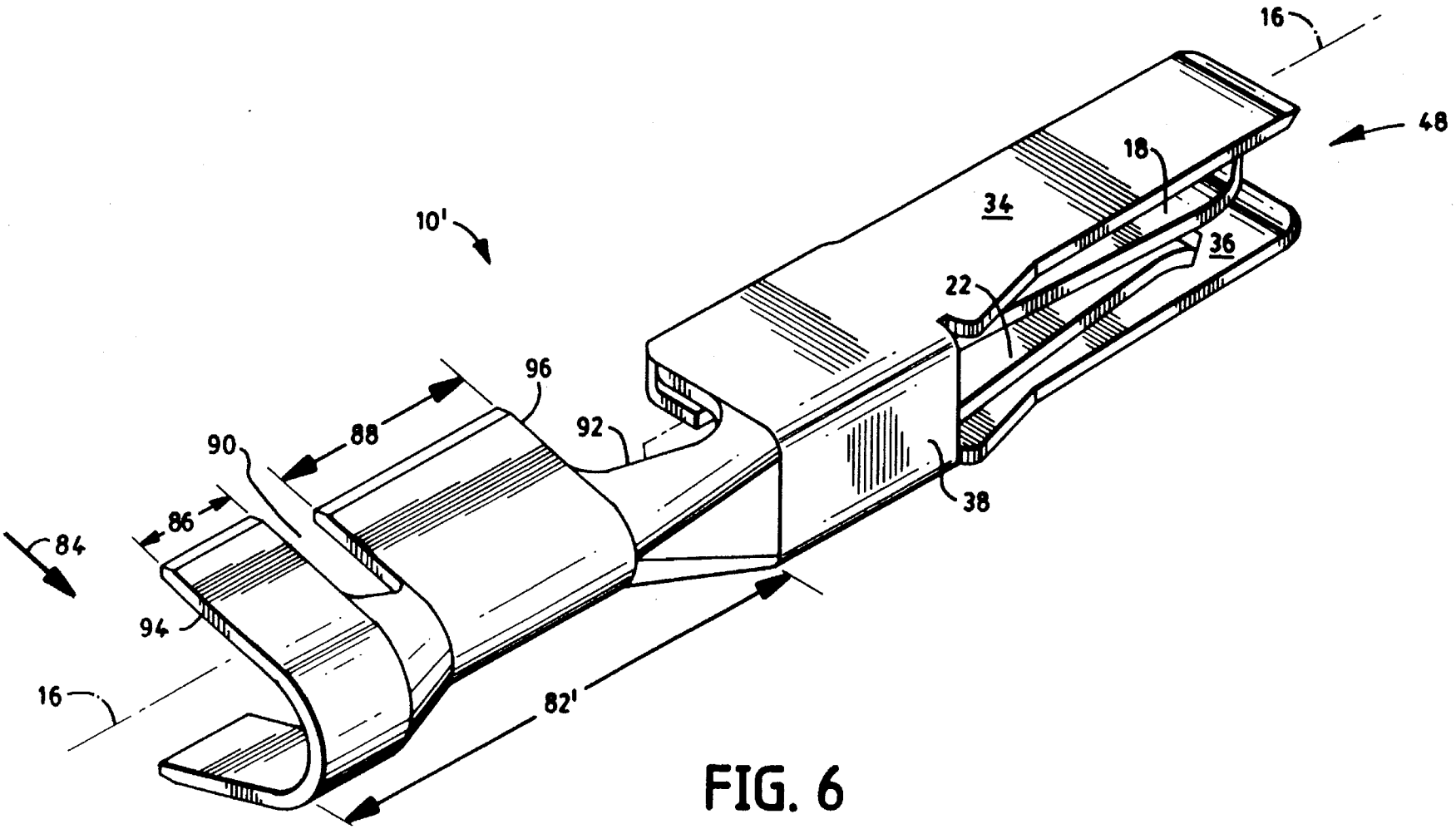

In order to fasten a conductor such as, for example, a strand of wire to the electrical contact 10, a conductor attachment segment is provided. A conductor (not shown) may be fastened to the conductor attachment segment in a conventional manner as, for example, by soldering and/or crimping or by means of an insulation displacement crimp. In the embodiment of FIG. 4, the conductor attachment segment is depicted in phantom lines 82. Such conductor attachment segment may be provided in any configuration suitable for attachment of the conductor to the electrical contact 10. Generally, in the preferred embodiment, the conductor attachment segment 82 will extend away from the electrical contact 10 in the direction of longitudinal axis 16. A preferred embodiment is depicted in FIG. 6 in which like reference numerals identify like elements. In FIG. 6 an electrical contact 10' includes a conductor attachment segment 82' which is generally concave in cross-section when viewed in the direction of arrow 84. The conductor attachment segment 82' includes an outermost U-shaped length 86, and another U-shaped length 88 adjacent to length 86. Lengths 86 and 88 are spaced from each other in the direction of longitudinal axis 16 at 90 and are joined to the bridging portion 38 by a neck portion 92 which extends from the bridging portion to the U-shaped length 88 in the direction of longitudinal axis 16. A conductor may be attached to the conductor attachment segment 82' by crimping the legs 94, 96 of lengths 86, 88, respectively, about the conductor in the conventional manner. Solder may be provided at the attachment if desired. Although not necessary, in the preferred embodiment the conductor attachment segment 82, 82' is integral with the stamped blank used in the fabrication of the electrical contact 10.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. An electrical contact comprising:

a first bifurcated beam which is electrically conductive and extends in the direction of a longitudinal axis;

a second bifurcated beam which is electrically conductive and extends in the direction of said longitudinal axis, said second bifurcated beam being spaced from said first bifurcated beam;

a first outer enclosing member which is electrically conductive and extends in the direction of said longitudinal axis adjacent to and spaced from said first bifurcated beam;

a second outer enclosing member which is electrically conductive and extends in the direction of said longitudinal axis adjacent to and spaced from said second bifurcated beam; and a bridging portion which is electrically conductive and which joins said first bifurcated beam, said second bifurcated beam, said first outer enclosing member and said second outer enclosing member, said bridging portion further comprising an end segment adjacent said first bifurcated beam which is turned towards and engages a portion of said bridging portion adjacent said second bifurcated beam.

2. The electrical contact of claim 1 wherein said first bifurcated beam and said second bifurcated beam form a beam segment having an upper portion enclosed by said first outer enclosing member, an opposite lower portion enclosed by said second outer enclosing member, a first open side portion and an opposite second open side portion.

3. The electrical contact of claim 1 wherein said bridging portion comprises a first protuberance adjacent said first bifurcated beam which engages said bridging portion adjacent said first outer enclosing member, and said bridging portion comprises a second protuberance adjacent said second bifurcated beam which engages said bridging portion adjacent said second outer enclosing member.

4. The electrical contact of claim 1 wherein said first bifurcated beam and said second bifurcated beam are biased towards each other.

5. The electrical contact of claim 1 wherein said first bifurcated beam includes a first tine having a first contact area and said second bifurcated beam includes an opposite second tine having a second contact area which is staggered relative to said first contact area in the direction of said longitudinal axis, and further wherein said first bifurcated beam includes a third tine having a third contact area and said second bifurcated beam includes an opposite fourth tine having a fourth contact area which is staggered relative to said third contact area in the direction of said longitudinal axis.

6. The electrical contact of claim 5 wherein said first tine, said second tine, said third tine and said fourth tine are each tapered in the direction of said longitudinal axis, each taper narrowing in a direction from said bridging portion towards an opposite end of said first bifurcated beam and said second bifurcated beam.

7. The electrical contact of claim 5 wherein said bridging portion includes an end segment adjacent said first line which is turned towards and engages a portion of said bridging portion adjacent said opposite second tine.

8. The electrical contact of claim 5 wherein said first contact area and said second contact area are biased towards each other, and said third contact area and said fourth contact area are biased towards each other.

9. The electrical contact of claim 5 wherein said second contact area is staggered relative to said third contact area.

10. The electrical contact of claim 1 further including a conductor attachment segment extending from said bridging portion.

11. The electrical contact of claim 10 wherein said conductor attachment segment generally extends in the direction of said longitudinal axis.

12. The electrical contact of claim 11 wherein said conductor attachment segment is concave in cross section and comprises an outermost first U-shaped length, a second U-shaped length adjacent to and spaced from said first U-shaped length, and a neck portion which extends from said bridging portion to said second U-shaped length.

13. An electrical contact formed from a single piece of electrically conductive material comprising:

a bridging portion;

a first outer enclosing member which extends from said bridging portion in the direction of a longitudinal axis, and which is folded with said bridging portion along a first fold line of said bridging portion;

a second outer enclosing member which extends from said bridging portion in the direction of said longitudinal axis and is spaced from said first outer enclosing member, and which is folded with said bridging portion along a second fold line of said bridging portion, said first outer enclosing member being substantially parallel to said second outer enclosing member;

a first bifurcated beam which extends from said bridging portion in the direction of said longitudinal axis and which is folded with said bridging portion towards and spaced from said first outer enclosing member along a third fold line which is parallel to said longitudinal axis; and a second bifurcated beam which extends from said bridging portion in the direction of said longitudinal axis and which is folded with said bridging portion towards and spaced from said second outer enclosing member along a fourth fold line which is parallel to said longitudinal axis, said bridging portion further including an end segment adjacent said first bifurcated beam which is turned towards and engages a portion of said bridging portion adjacent said second bifurcated beam.

14. The electrical contact of claim 13 wherein said bridging portion comprises a first protuberance adjacent said first bifurcated beam which engages said bridging portion adjacent said first outer enclosing member, and said bridging portion comprises a second protuberance adjacent said second bifurcated beam which engages said bridging portion adjacent said second outer enclosing member.

15. The electrical contact of claim 13 wherein said first bifurcated beam includes a first tine having a first contact area and said second bifurcated beam includes an opposite second tine having a second contact area which is staggered relative to said first contact area in the direction of said longitudinal axis, and further wherein said first bifurcated beam includes a third tine having a third contact area and said second bifurcated beam includes an opposite fourth tine having a fourth contact area which is staggered relative to said third contact area in the direction of said longitudinal axis.

16. The electrical contact of claim 15 wherein said first tine, said second tine, said third tine and said fourth tine are each tapered in the direction of said longitudinal axis, each taper narrowing in a direction from said bridging portion towards an opposite end of said first bifurcated beam and said second bifurcated beam.

17. The electrical contact of claim 15 wherein said first contact area and said second contact area are biased towards each other, and said third contact area and said fourth contact area are biased towards each other.

18. The electrical contact of claim 15 wherein said second contact area is staggered relative to said third contact area.

19. The electrical contact of claim 13 further including a conductor attachment segment extending from said bridging portion.

20. The electrical contact of claim 19 wherein said conductor attachment segment is concave in cross section and comprises an outermost first U-shaped length, a second U-shaped length adjacent to and spaced from said first U-shaped length, and a neck portion which extends from said bridging portion to said second U-shaped length.

* * * * *